United States Patent [19]

Elkin

[11] 4,041,747

[45] Aug. 16, 1977

[54] PIPE GROOVING APPARATUS

[75] Inventor: Robert D. Elkin, Claremont, Calif.

[73] Assignee: Collins Machinery Corporation, Monterey Park, Calif.

[21] Appl. No.: 711,800

[22] Filed: Aug. 5, 1976

[51] Int. Cl.[2] ..... B21D 17/04

[52] U.S. Cl. ..... 72/105

[58] Field of Search ..... 72/101, 105, 106

[56] References Cited

U.S. PATENT DOCUMENTS

| | | | |
|---|---|---|---|
| 425,516 | 4/1890 | Leavy | 72/101 |
| 2,925,116 | 2/1960 | Eberle | 72/105 |
| 3,015,502 | 1/1962 | Frost et al. | 72/101 |
| 3,541,826 | 11/1970 | Halliburton | 72/105 |
| 3,903,722 | 9/1975 | Thau et al. | 72/105 |

*Primary Examiner*—Lowell A. Larson
*Attorney, Agent, or Firm*—William W. Haefliger

[57] ABSTRACT

Apparatus for grooving pipe extending longitudinally axially comprises:

a. a transversely elongated frame adapted to be displaced transversely relative to the pipe axis, b. a grooving roller having an annular boss to swage the groove in the pipe, and a back-up roller having an annular recess in transverse alignment with said boss, said rollers carried by the frame, c. and means to bodily and progressively displace one of the rollers relatively toward the other roller to cause the boss to progressively form the groove in the pipe wall being rotated between the rollers, the two rollers being rotated in response to pipe rotation.

10 Claims, 7 Drawing Figures

FIG. 1.
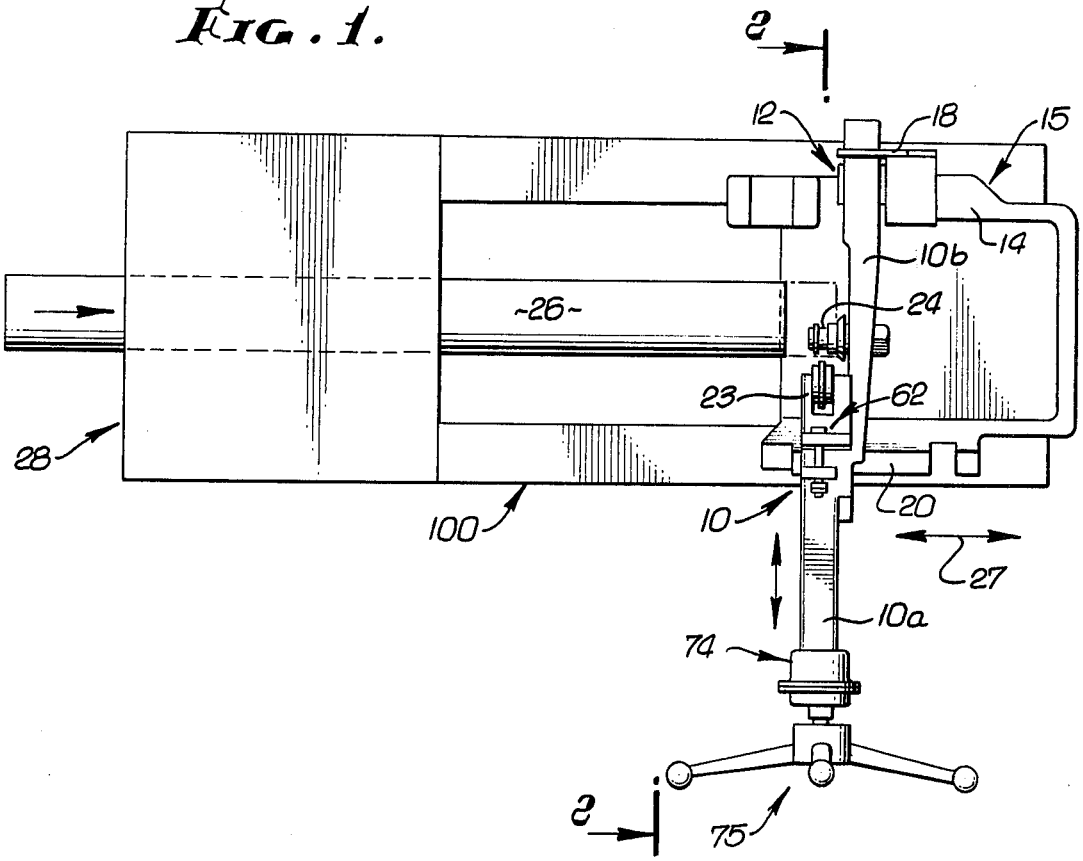
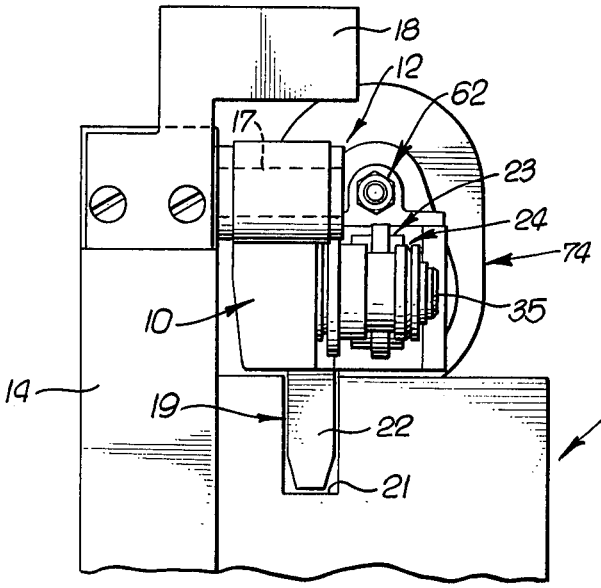
FIG. 4.

PIPE GROOVING APPARATUS

BACKGROUND OF THE INVENTION

This invention relates generally to pipe grooving, and more particularly concerns apparatus enabling efficiently controllable grooving of pipe walls which are rotated relative to the apparatus.

Apparatus for rotating and threading pipe is exemplified by U.S. Pat. No. 3,274,627. Under certain conditions it is desired that pipe ends be grooved rather than threaded, for coupling to other and likewise grooved pipe ends. There is need for improved apparatus enabling rapid, efficient and controllable grooving of pipe which is rotated in fixed position, as during threading. In this regard, prior grooving equipment lacked the unusual combinations of structure, function and results as are now afforded by the present invention.

SUMMARY OF THE INVENTION

Basically, the invention is embodied in apparatus for grooving pipe extending longitudinally axially, and comprises a. a transversely elongated frame adapted to be displaced transversely relative to the pipe axis, b. a grooving roller having an annular boss to swage the groove in the pipe, and a back-up roller having an annular recess in transverse alignment with said boss, said rollers carried by the frame, c. and means to bodily and progressively displace one of the rollers relatively toward the other roller to cause the boss to progressively form the groove in the pipe wall being rotated between the rollers, the two rollers being rotated in response to pipe rotation.

As will appear, carriage structure typically carries the frame for bodily transverse displacement to displace both rollers into position to receive the pipe wall therebetween; the structure floatably carries the frame for such displacement whereby the rollers and frame may be bodily and adjustably displaced in reponse to forces generated during groove formation; pivoting of the frame up and down, into and out of position to receive the pipe is accommodated as by a lost-motion connection between the carriage and the frame, that connection also accommodating the floating action as described; the carriage may be slidable longitudinally during groove formation to assure proper spacing of the groove from the pipe end, the latter urged toward a flange on the back-up roller; a rail on the frame typically engages a ledge on the carriage structure to limit down-pivoting of the frame relative to the carriage and also affords low-friction transverse sliding of the frame on the carriage; and unusually advantageous yoke support and feed mechanism is provided for the grooving roller with a speed reduction transmission positioned to overhang the side of the carriage and contribute to down-loading tending to retain the frame in down position during groove formation.

These and other objects and advantages, as well as the details of an illustrative embodiment, will be more fully understood from the following description and drawings, in which:

DRAWING DESCRIPTION

FIG. 1 is a plan view of equipment incorporating the invention;

FIG. 4 is an end elevation taken on lines 4—4 of FIG. 2;

DETAILED DESCRIPTION

Figure 2:
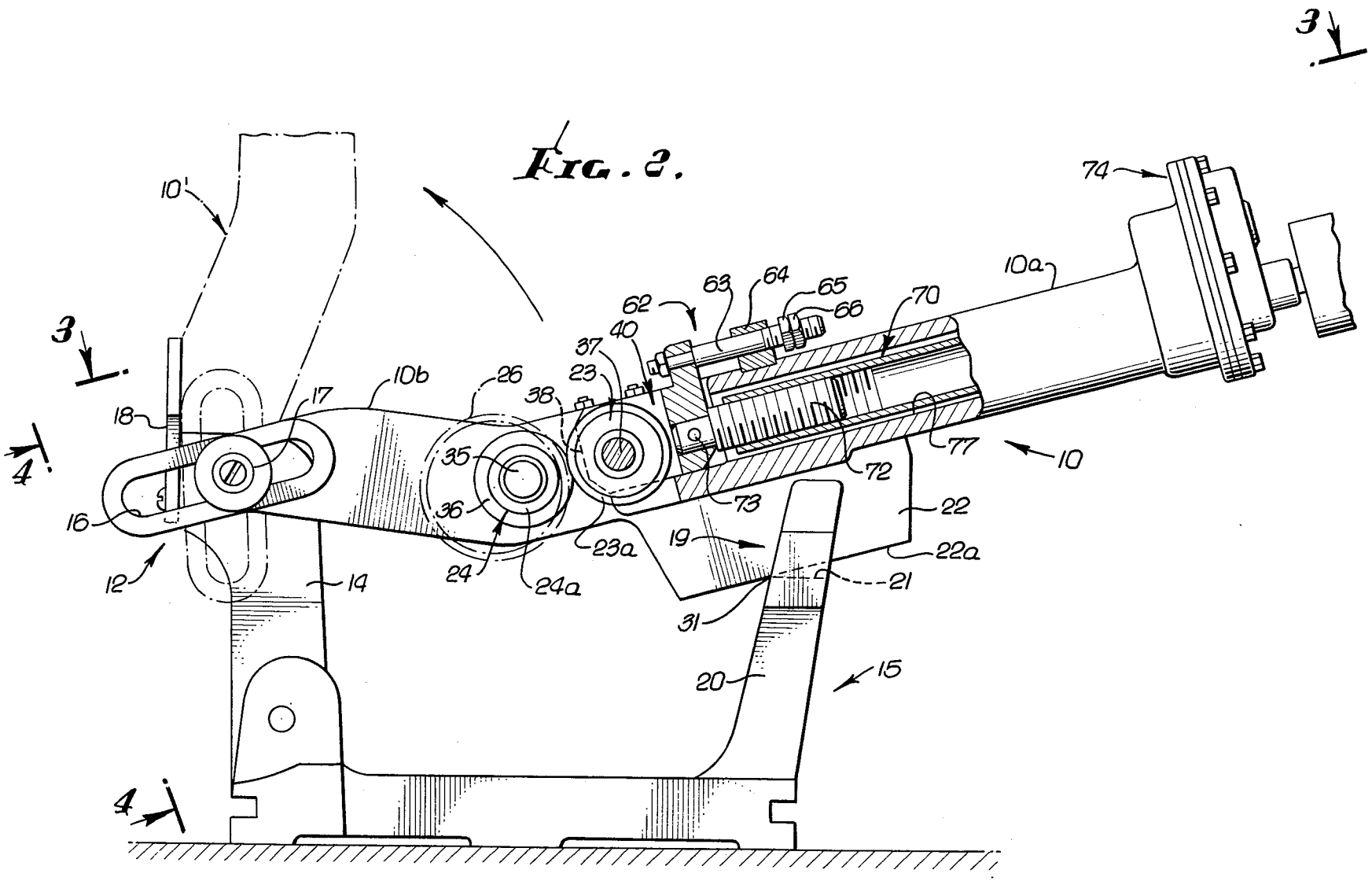
FIG. 2 is an enlarged elevation taken on lines 2—2 of FIG. 1.
Figure 3:
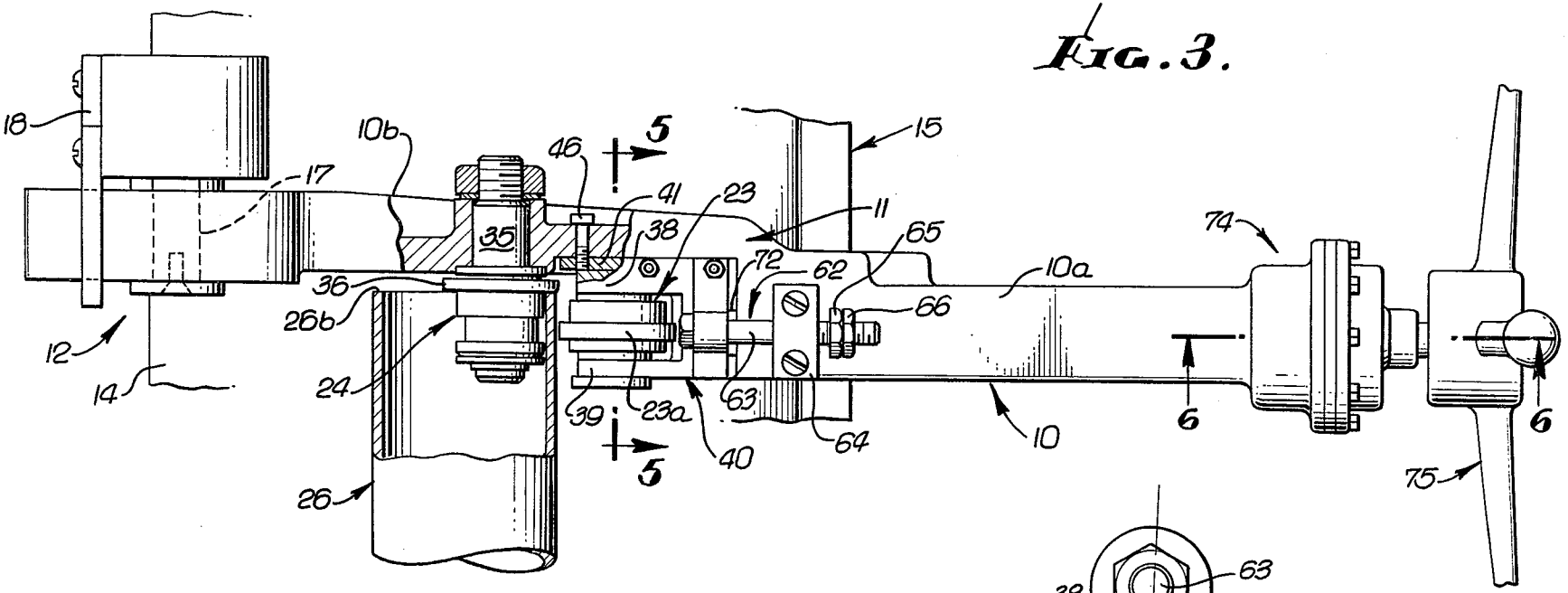
FIG. 3 is a plan view on lines 3—3 of FIG. 2.

Referring first to FIGS. 1, 2 and 3, a transversely elongated frame 10 includes sections **10*a* and 10*b* which are integrally joined at 11, so that the two sections have flat V configuration. Section 10*b* has lost-motion connection as at 12 to an upright member 14 of carriage structure 15. The connection 12 may advantageously include a transversely elongated slot 16 in section 10*b*, and a pin 17 extending through the slot. The pin may be integral with a member 14, and a bracket 18 may be attached to part 14 to limit counter-clockwise pivoting of the frame to upright position, as indicated by broken lines 10' in FIG. 2**.

The carriage structure also supports the frame at a transversely rightwardly spaced location 19, as also seen in FIG. 2, whereby clockwise downward pivoting of the frame is blocked at said location. For this purpose, the carriage 15 may include a second upright member 20 which is downwardly slotted to provide a ledge 21 seating the flange 22 projected downwardly from the frame section **10*a*. Flange lower edge 22*a* engages the ledge at point 31, allowing transverse shifting of the frame, with low friction. A grooving roller 23 and a back-up roller 24 to be described later, are positioned generally between the lost motion connection 12 and the support location, whereby transverse shifting of those rollers to accommodate to the pipe during grooving, and transmitted to the frame, acts to bodily displace the floating frame via transverse forces located generally in alignment with the locations 12 and 19 so as not to pivot the frame out of position about the pivot 17 during grooving. The overhanging heavy weight of the frame section 10*b* to the right of load point 31, also tends to keep the frame in down position. Note the position of the pipe 26 being grooved between the two rollers in FIG. 2**, such rollers being located near the downward apex of the flat V-shape of the frame.

The carriage 15 is shiftable longitudinally endwise in the direction of arrows 27 in FIG. 1, to precisely locate or maintain the two rollers relative to the encompassed end of the pipe, as during grooving. The pipe itself may be supported, axially positioned, and rotatably driven as by mechanism 28; the latter may for example comprise a THRED-O-MATIC 66-A Manufactured by Collins Machinery Corporation of Monterey Park, Calif. See also U.S. Pat. No. 3,274,627. Accordingly, the grooving mechanism floatably adjusts itself transversely and longitudinally to the pipe position, while pipe rotation serves to relatively advance the grooving rollers about the pipe, as will further appear. Base 100 carries both mechanism 28 and the carriage 15.

Figure 7:
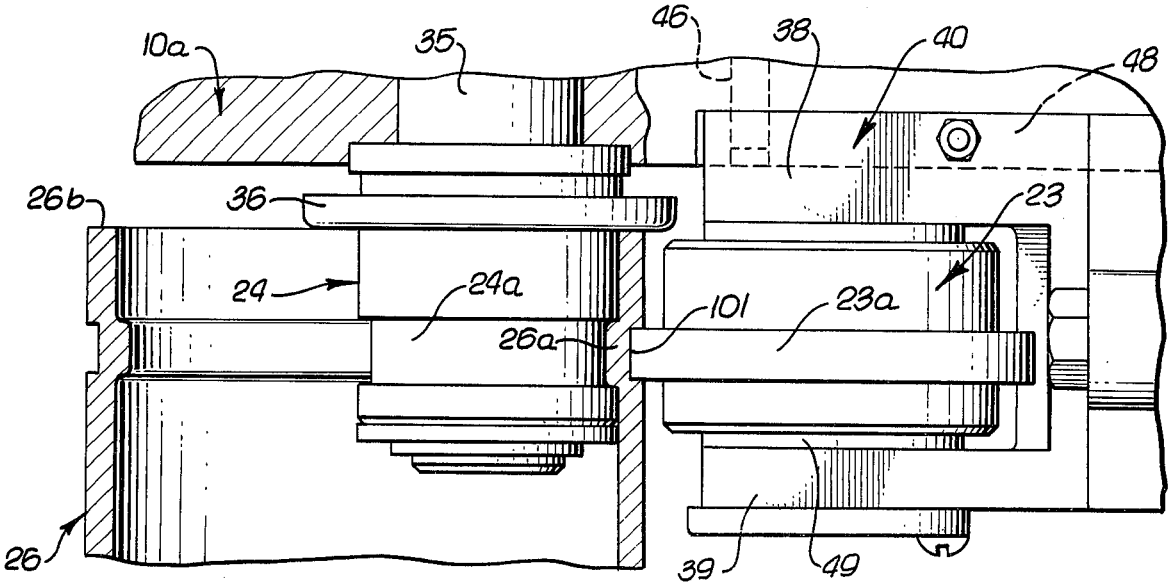
FIG. 7 is an enlarged section showing accomplishment of pipe wall grooving.

The grooving roller 23 has an annular boss or flange **23*a* to swage the groove in the pipe as the pipe rotates (see FIG. 7); and the back-up roller 24 has an annular recess 24*a* in transverse, co-planar, alignment with boss 23*a* to receive the radially inwardly swaged annular extent 26*a* of the pipe. The recess 24*a* is wider than the boss, as shown. Note that roller 24 is journaled on a trunnion 35** received in the frame, and that a stop flange 36 is carried on the roller to rotate therewith. Flange 36 limits or stops the end 26*b* of the pipe, as seen in FIGS. 3 and 7.

Figure 5:
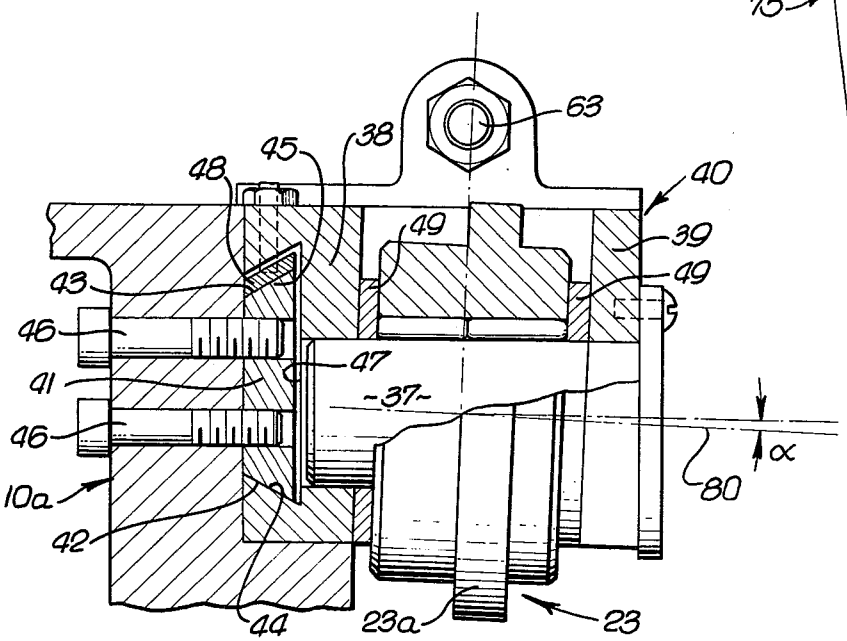
FIG. 5 is a section on lines 5—5 of FIG. 3.

Means is provided to bodily and progressively displace one of the rollers, as for example roller 23, relatively toward the other roller to cause the annular boss on the grooving roller to progressively form the groove in the pipe wall being rotated between the rollers, which are rotated in response to pipe rotation. Such means may advantageously include an axle 37, the opposite ends of which are supported by the arms 38 and 39 of a yoke 40. The yoke arm 38 has dove-tail, longitudinally guided interfit with the frame section 10*a* as shown in FIG. 5, and specifically, the frame may carry a plate 41 having dove-tail guide surfaces 42 and 43 which interfit guide surfaces 44 and 45 on the yoke. Fastener 46 removably attaches the plate 41 to the frame to fit in a yoke side recess 47. A bearing strip 48 is carried by the yoke and defines surface 45. Spacer washers 49 are positioned between the roller 23 and the inner faces of yoke arms 38 and 39.

Figure 6:
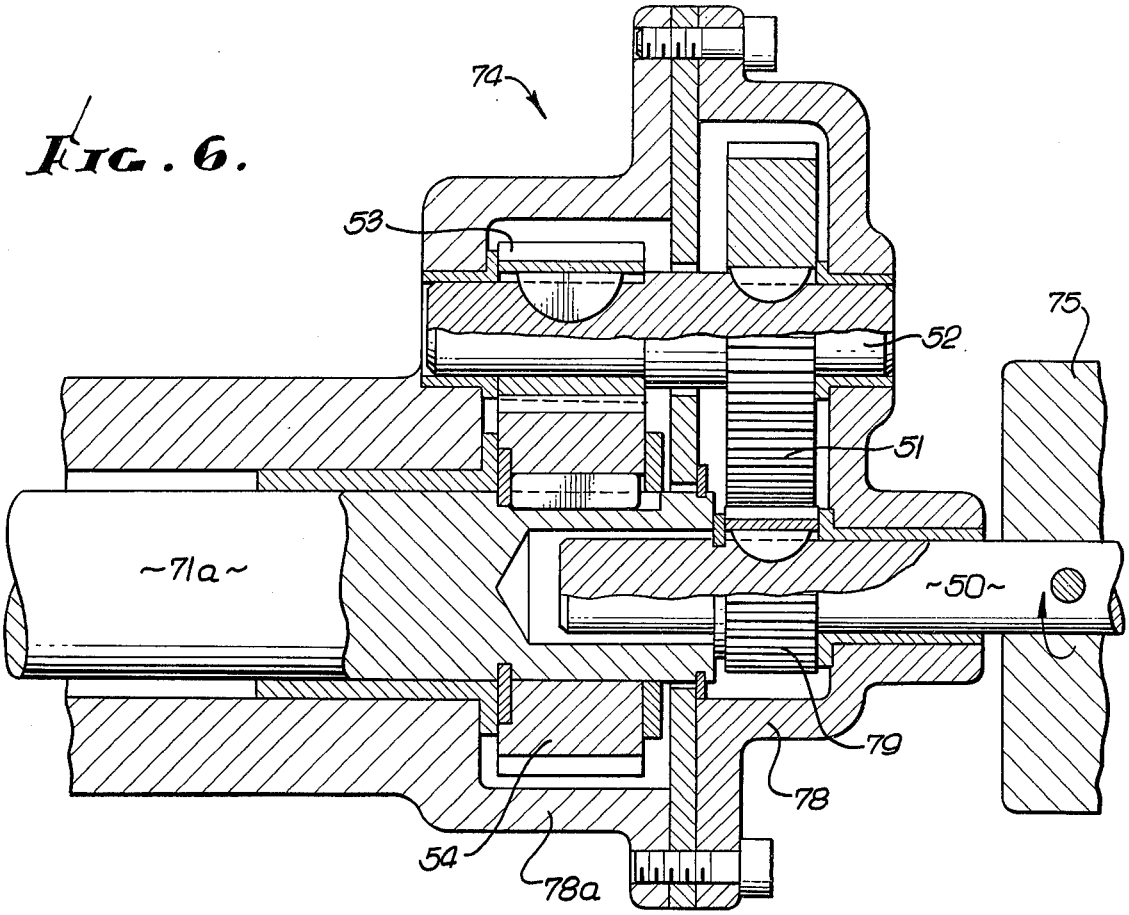
FIG. 6 is an enlarged section taken on lines 6—6 of FIG. 3.

Transverse feed mechanism is typically carried by the frame section 10*a* and connected to the yoke to displace it transversely and relative to the frame. The illustrated feed mechanism 70 includes first and second transversely elongated members 71 and 72 having telescopic threaded interfit, whereby in-place rotation of member 71 effects transverse or endwise displacement of the second member 72. The latter may be in the form of an externally threaded feed screw connected to the yoke at 73, and member 71 may have the form of an internally threaded sleeve. Both members 71 and 72 may be advantageously located within a bore 77 in the frame section 10*a*. The right end 71*a* of member 71 may have the form of a shaft, as seen in FIG. 6, and rotated via a speed-reducing transmission 74 to which input rotation is impacted by hand-wheel 75. The transmission may include housing sections 78 and 78*a* containing a relatively small diameter spur gear 79 on input shaft 50; a relatively large diameter idler gear 51 keyed to shaft 52 and meshing with gear 79, a relatively small diameter gear 53 keyed also to shaft 52, and a relatively large diameter gear 54 keyed to shaft 71*a* and meshing with gear 53. Accordingly, as the hand-wheel is rotated in one direction, the grooving roller is slowly and progressively advanced toward the back-up roller to form the pipe wall groove; and as the hand-wheel is rotated in the opposite direction, the grooving roller is displaced away from the back-up roller and out of the formed groove to free the pipe for removal.

Reference to FIG. 5 will show that the grooving roller 23 has an axis 80 of rotation which extends at a small angle (i.e. is skewed) relative to the axis of rotation of the back-up roller, whereby the grooving roller tends to urge the pipe relatively toward the stop flange 36, during grooving. This assures that the groove 101 formed in the pipe wall will be at a uniform distance from the pipe end 26*b*. Note skew angle $\alpha$ in FIG. 5.

A stop mechanism to limit the depth of the formed groove is shown at 62 in FIG. 2. That mechanism may include a rod 63 carried by the yoke and extending transversely through a stop collar 64 on the frame 10*a*; and nuts 65 and 66 on threaded extent 63*a* of the rod. The nuts are adjustably positioned to engage the stop collar when the desired groove depth is attained.

I claim:

1. In apparatus for grooving pipe extending longitudinally axially, the combination comprising a. a tranversely elongated frame adapted to be displaced transversely relative to the pipe axis, b. a grooving roller having an annular boss to swage the groove in the pipe, and a back-up roller having an annular recess in transverse alignment with said boss, said rollers carried by the frame, c. and means to bodily and progressively displace one of the rollers relatively toward the other roller to cause the boss to progressively form the groove in the pipe wall being rotated between the rollers, the two rollers being rotated in response to pipe rotation, d. there being carriage structure carrying the frame for bodily transverse displacement to displace both rollers into position to receive the pipe wall therebetween, said structure floatably carrying the frame for said displacement, whereby the two rollers and frame may be bodily displaced transversely in response to groove formation.

2. The combination of claim 1 including a lost motion connection between the carriage structure and the frame and characterized as providing for transverse displacement of the frame and also pivoting of the frame, relative to the carriage structure.

3. The combination of claim 2 wherein the carriage structure also supports the frame at a transversely spaced location relative to the lost motion connection, whereby downward pivoting of the frame is blocked at said location, said rollers positioned generally between said lost motion connection and said location when the frame is lowered to be blocked at said location.

4. The combination of claim 3 including drive means supporting said pipe for rotation, and a base supporting the drive means and said carriage structure which is movable on the base toward and away from the drive structure.

5. The combination of claim 1 wherein said means includes an axle supporting the grooving roller, a yoke supporting the axle, and transverse feed mechanism carried by the frame and connected to the yoke to displace the yoke transversely and relative to the frame.

6. The combination of claim 5 wherein said feed mechanism includes first and second transversely elongated members having telescopic and threaded interfitting relation, whereby rotation of the first member effects transverse displacement of the second member which is connected with the yoke.

7. The combination of claim 6 wherein said feed mechanism includes a manually rotatable element, and a speed reducing transmission operatively connected between the element and said first member, said transmission carried by the frame.

8. The combination of claim 1 including a flange on a spindle supporting the back-up roller, the flange projecting to engage and locate the end of the pipe relative to the frame.

9. The combination of claim 8 wherein the grooving roller has an axis of rotation extending at a small angle relative to the axis of rotation of the back-up roller whereby the grooving roller tends to relatively urge the pipe toward the flange, during grooving.

10. The combination of claim 6 including stop mechanism on the yoke and frame to limit feeding of the feed mechanism when the desired groove depth is attained.

* * * * *